US005803275A

United States Patent [19]

Schweitzer

[11] Patent Number: 5,803,275

[45] Date of Patent: Sep. 8, 1998

[54] ARTICLE HOLDER

[75] Inventor: Robert A. Schweitzer, Robinsdale, Minn.

[73] Assignee: Minnesota American, Inc., Minnetonka, Minn.

[21] Appl. No.: 730,074

[22] Filed: Oct. 15, 1996

Related U.S. Application Data

[63] Continuation-in-part of Ser. No. 56,099, Jun. 21, 1996, Pat. No. Des. 383,633.

[51] Int. Cl.[6] ..... A47F 7/00

[52] U.S. Cl. ..... 211/88.01; 211/55; 211/10

[58] Field of Search ..... 211/10, 50, 55, 211/88.01, DIG. 1, 128.1; 248/206.5; 312/245

*Primary Examiner*—Robert W. Gibson, Jr.
*Attorney, Agent, or Firm*—Burd, Bartz & Gutenkauf

[57] ABSTRACT

An article holding apparatus having front, rear, side and bottom walls of uniform thickness forming a box. The box has a slanted open top surface to provide easy access to writing instruments and supplies, and personal items. A middle wall extends generally parallel to the front and rear walls dividing the article carrying space of the box into a forward and rear portions. A plurality of transverse upright walls extend between the middle wall and the front wall further dividing the forward portion of the article carrying space into a plurality of forward pockets. An inner wall is located in a longitudinal plane above the bottom wall. Upright inside walls are joined to the inner wall and bottom wall to define an inner compartment open to the front thereof. A vertically slidable sheet member having an outer reflective surface is mounted on the front of the box. The sheet member encloses the inner compartment. A sheet of magnetized material is secured to the back of the holder to attach the holder on a metal support.

30 Claims, 3 Drawing Sheets

ARTICLE HOLDER

CROSS REFERENCE TO RELATED APPLICATION

This application is a continuation-in-part of U.S. application Ser. No. 29/056099 filed Jun. 21, 1996, now U.S. Pat. No. Des. 383,633.

FIELD OF THE INVENTION

The article holder of this disclosure is in the field of boxes having doors and compartments in association with open top pockets for accommodating objects and articles.

BACKGROUND OF THE INVENTION

Numerous types and styles of open top boxes have been designed for holding articles and objects. These boxes included doors and compartments. For example, Ferris in U.S. Pat. No. 821,350 discloses a receptacle having a plurality of trays. The top tray has vertical partitions forming a plurality of pockets open at their ends and partially at the top. The trays are inserted in the casing of the box. Roggenkamp in U.S. Pat. No. 4,448,307 discloses a dental supply dispenser having spaced transverse partitions which define a plurality of frontally open compartments. The end compartments are open at the top. A hinged door is mounted over the opening to one of the compartments.

SUMMARY OF THE INVENTION

The invention is directed to an article holder for accommodating one or more articles such as pencils, paper, combs and other items. The holder is a generally rectangular box having a slanted open top surface with a plurality of pockets. Each pocket has an open top and a closed bottom to allow articles and objects to be stored in the pocket. The article holder has a generally narrow profile with linear top edges and large openings into the tops of the pockets to provide easy access to various articles and objects. The holder has a front wall, rear wall and side walls forming the outside walls of the box. An internal middle wall and transverse partition walls of the box form the pockets. The transverse partition walls and side walls slant downwardly and forwardly from the rear of the box to the front thereof at a 45 degree angle relative to the horizontal. The pockets are generally rectangular and are defined by flat walls surrounding the pockets. A bottom wall closes the bottom of the holder and the bottoms of each of the rear pocket and two of the forward pockets. A horizontal wall located above and generally parallel to the bottom wall closes the bottom of the remaining forward pocket. A pair of upright inside walls joined to the horizontal wall and bottom wall define an inner storage chamber. The front wall has an opening aligned with the storage chamber to provide a front entrance to the storage chamber. A vertically slidable sheet member mounted on the front wall of the holder closes the opening in the front wall to conceal the storage chamber. The concealed storage chamber is a secret hiding space within the holder. A second sheet member, such as a paper note pad, is vertically slidably mounted on the front of the holder adjacent the first sheet member. The walls and top edges of the holder having a uniform thickness to prevent warping of the walls during molding manufacturing process used to make the holder. A middle wall extends between the side walls generally parallel to the front and rear walls to divide the compartment of the holder into a front portion and rear portion. Transverse partition walls extend between the middle wall and the front wall to divide the front portion of the holder compartment into three Forward pockets. The bottom wall and horizontal wall function to support items contained in the pockets. In addition, the pockets are elongated to prevent items from inadvertently falling out of the pockets. Attachment means is attached to the rear wall. The attachment means can be a plastic sheet containing magnetic material which allows the holder to be releasably mounted on a metal support, such as a metal locker.

DESCRIPTION OF PREFERRED EMBODIMENT

Figure 1:
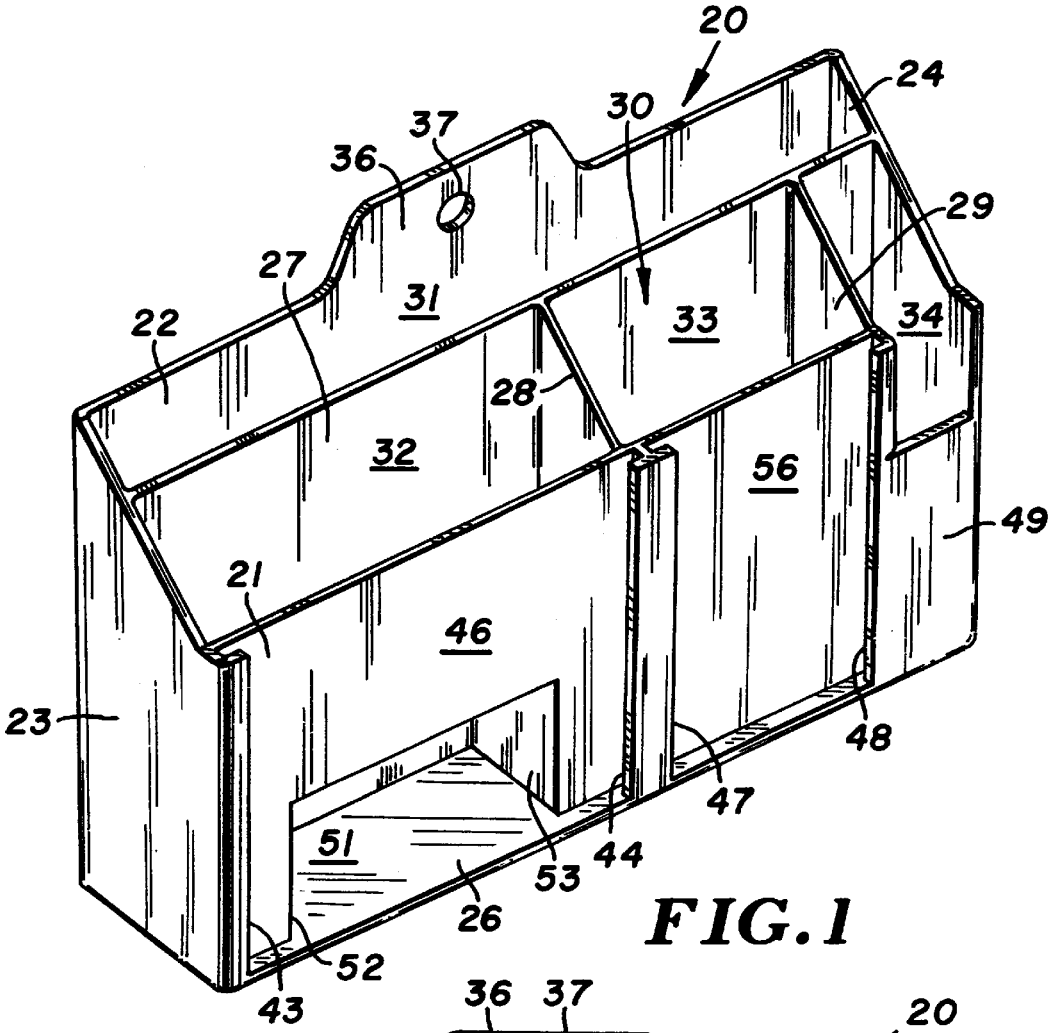
FIG. 1 is a perspective view of the article holder of the invention.
Figure 2:
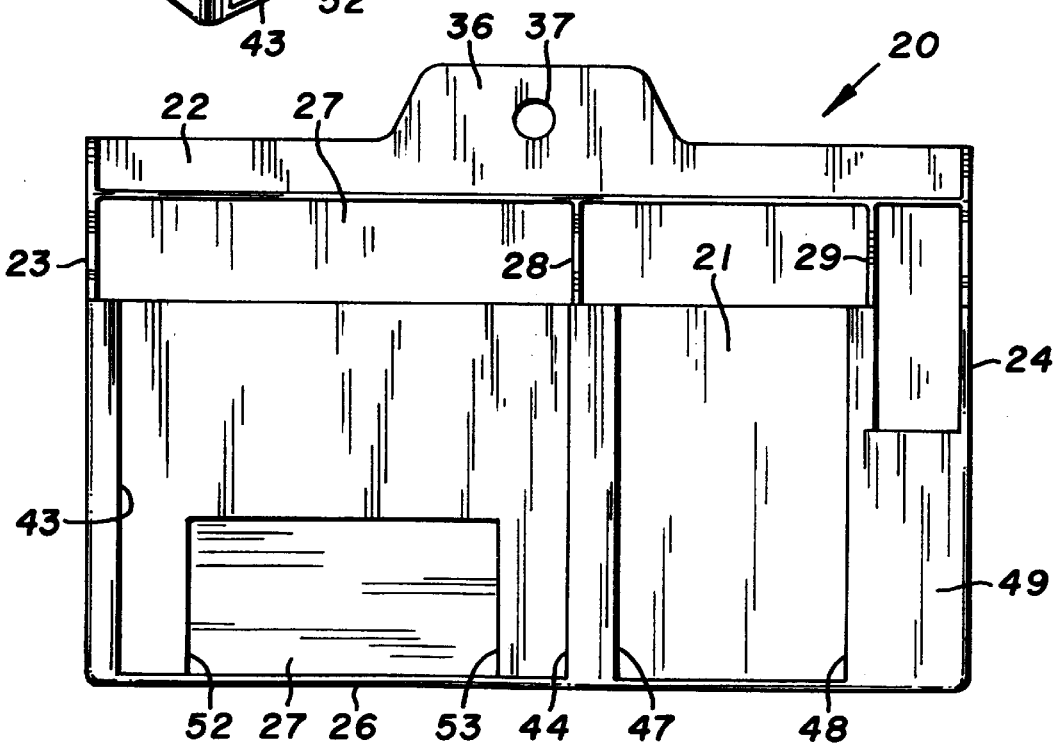
FIG. 2 is a front elevational view of FIG. 1.

Referring to FIGS. 1 and 2, there is shown an article holder indicated generally at 20. Article holder 20 is a generally rectangular container for accommodating and organizing a plurality of objects and articles such as pens, pencils, note pads, lunch tickets, stamps, coins, combs, brushes, nail files, letter openers, scissors and like items. Article holder 20 has an inner storage chamber 51 open to the front thereof. Chamber 51 is an enclosed secret hiding space within the holder 20 for personal articles. A vertically slidable sheet member 42, such as a mirror, is mounted over the opening to storage chamber 51 in front wall 21 to enclose the chamber. Holder 20 has a plurality of flat surfaces joined with linear, vertical and horizontal lines. The holder has a relatively flat box structure having a downwardly inclined top opening with a plurality of pockets 31–34. The open top provides relatively large openings into each pocket of holder 20 to facilitate access to the objects and articles. Also, holder 20 has minimal top structure to interfere with placement of items in the pockets. The walls and partitions of holder preferably are generally flat linear walls having a uniform thickness whereby holder 20 can be molded from a plastic material, such as polyethylene. Other materials can be used to construct the walls and partitions of holder 20. A generally rectangular magnet sheet member 38 on the back of the holder functions to retain holder 20 on magnetic metal supports, such as a metal locker or file cabinet. Article holder 10 can be used in office, academic, recreational and home environments. For example, holder 20 can be used in a school locker for accommodating a student's school supplies, personal items and the like.

Figure 5:
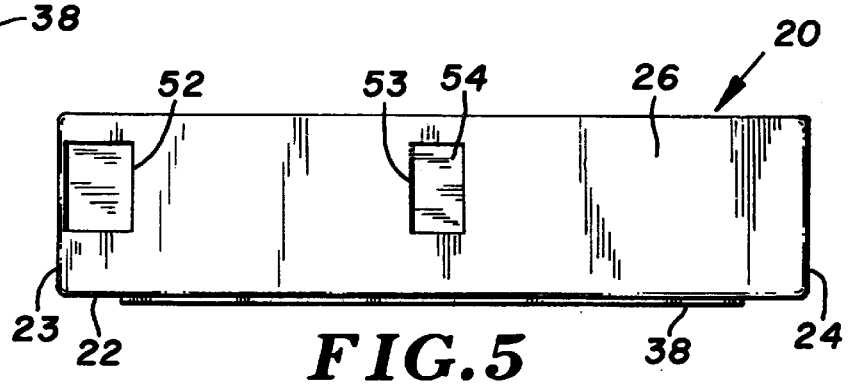
FIG. 5 is a bottom plan view of FIG. 1.

Article holder 20 has a first upright or front wall 21 laterally spaced from a second upright or back wall 22. An upright forward wall section 49 is laterally spaced forwardly from front wall 21. Front wall 21 extends higher than forward wall section 49 and back wall 22 extends higher than front wall 21. The upper edge of back wall 22 has an upwardly projected tab 36 having a hole 37 for hanging holder 20 on a vertical surface. One end of each of the front and back walls 21 and 22 is secured to an upright side wall 23. Holder 20 has a second upright side wall 24 which is generally parallel to side wall 23 and extends between back wall 22 and forward wall section 49. An upright interior wall or middle wall 27 is connected to side walls 23 and 24 extending generally parallel to and between front wall 21 and rear wall 22. As shown in FIG. 5, a generally flat bottom wall 26 substantially closes the bottom of holder 20.

Figure 4:
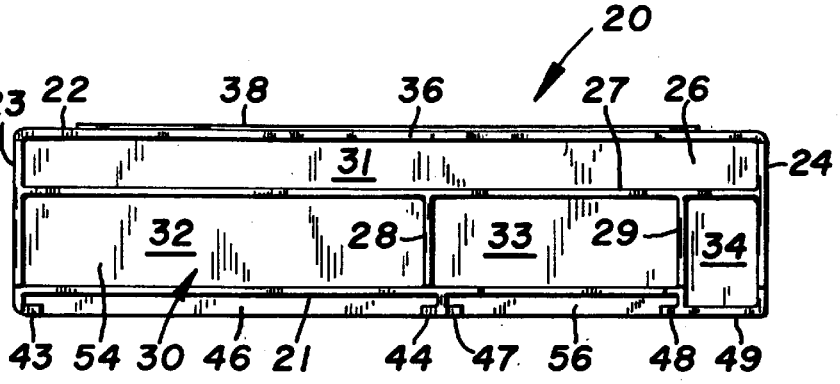
FIG. 4 is a top plan view of FIG. 1.

Referring to FIGS. 1, 2 and 4, transverse generally upright partition walls 28 and 29 are secured to middle wall 27. Partition 28 extends between middle wall 27 and front wall 21. Partition 29 extends generally parallel to partition 28 between middle wall 27 and forward wall section 49. A longitudinal inner wall 54 is joined to side wall 23 and partition 28. Inner wall 54 is located at an elevated position above and extends generally parallel to bottom wall 26. Middle wall 27 divides the article carrying space of holder 20 into a forward portion indicated generally at 30 and a rear portion or pocket 31. Partitions 28 and 29 further divide forward portion 30 of the article carrying space into three separate forward pockets 32, 33 and 34. Rear pocket 31 is an elongated generally rectangular shaped open top pocket defined by front wall 22, side walls 23 and 24, and middle wall 27. The bottom of pocket 31 is closed with bottom wall 26. Pocket 31 extends longer than each of pockets 32–34. Forward pockets 32–34 are generally rectangular shaped open top pockets which are each wider than rear pocket 31. Pocket 32 is defined by side wall 23, middle wall 27, and partition 28. The bottom of pocket 32 is closed with inner wall 54. Pocket 33 is defined by front wall 21, bottom wall 26 and middle wall 27, and partitions 28 and 29. Pocket 34 is defined by side wall 24, bottom wall 26, forward wall section 49, and partition 29. As seen in FIGS. 1 and 2, forward wall section 49 extends lower than front wall 21 thereby increasing the top opening of pocket 34 to provide easy access to various longer instruments, such as writing instruments.

Figure 3:
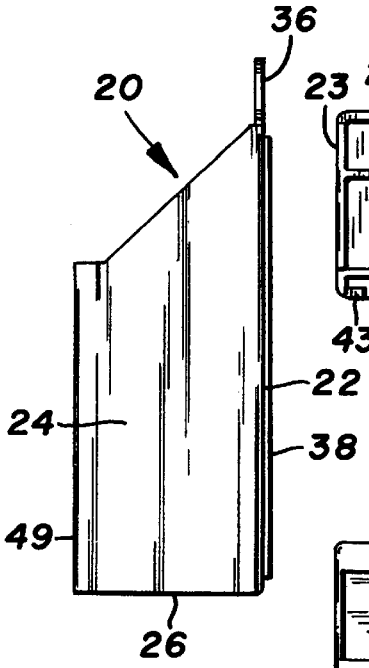
FIG. 3 is a side elevational view of the right side of FIG. 1.

Side walls 23 and 24 and partitions 28 and 29 each have a forwardly and downwardly inclined top edge. The top edges of side walls 23 and 24 and partitions 28 and 29 preferably incline at an angle of 45 degrees with respect to the horizontal or bottom wall 26, as seen in FIG. 3. The top edges of walls 23 and 24 and partitions 28 and 29 can incline at other angles. The slanted open top structure of holder 20 provides relatively large openings into each pocket 31–34 to facilitate access to the objects and articles.

Referring to FIGS. 1 and 5, a pair of generally upright internal walls 52 and 53 extend upwardly from bottom wall 26 to longitudinal inner wall 54 to provide a storage chamber or inner compartment 51 for accommodating personal items and the like. Internal walls 52 and 53 are located between side wall 23 and partition 28. Compartment 51 is a generally rectangular shaped storage chamber located directly below pocket 32. Upright internal walls 52 and 53, middle wall 27, bottom wall 26 and inner wall 54 define compartment 51. Compartment 51 is open to the front of holder 20. Front wall 21 has a rectangular opening aligned with the front of compartment 51 providing access to the compartment. A vertically slidable sheet member 42 can be slid over the opening in front wall 21 to conceal compartment 51 and enclose and conceal the contents therein. The bottom of sheet member 42 rests on a lip or front edge of bottom wall 26 to prevent sheet member 42 from sliding out of holder 20.

Figure 7:
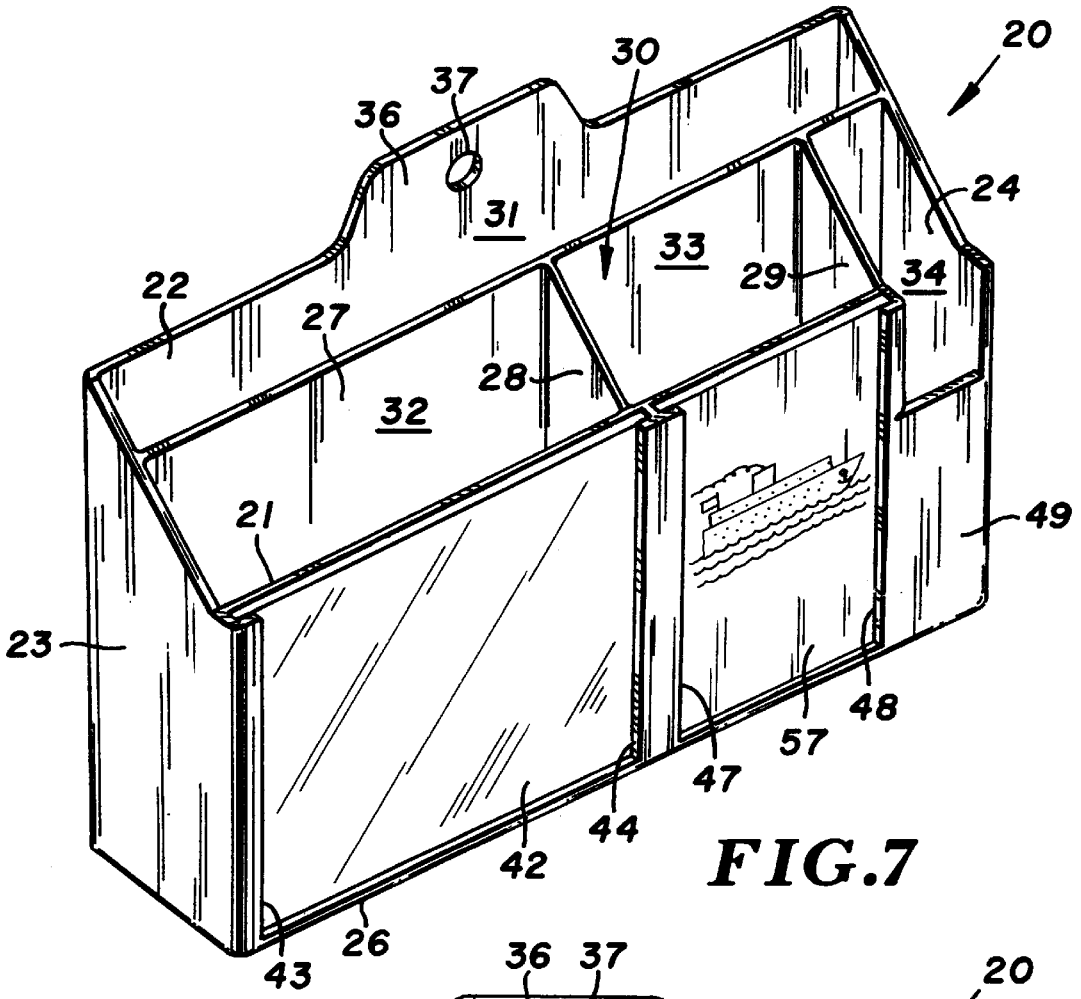
FIG. 7 is a perspective view of the article holder of the invention showing the mirror and card mounted on the front thereof.
Figure 8:
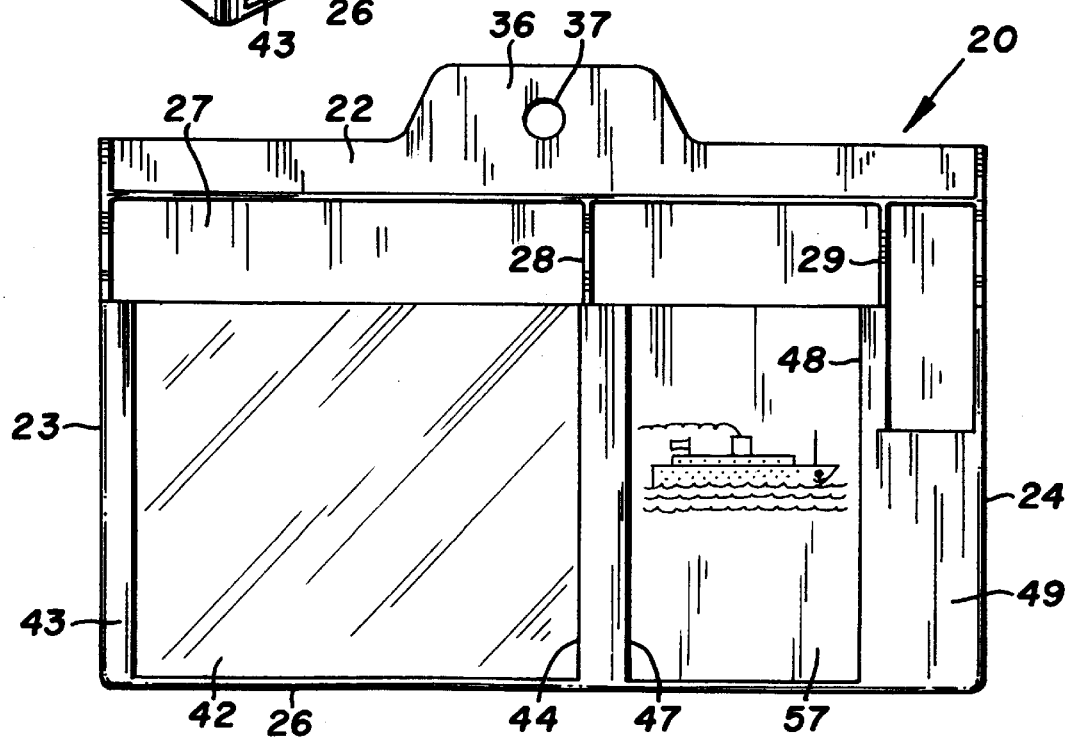
FIG. 8 is a front elevational view of FIG. 7.

Referring to FIGS. 7 and 8, sheet member 42 is mounted on the front of holder 20 over the opening of compartment 51. Sheet member 42 is a generally flat member, such as a mirror having an outer reflective surface whereby one can see a reflection of himself or herself. The outer surface of sheet member 42 can accommodate other structures, graphics, representations and the like. Flanges 43 and 44 secured to front wall 21 extend forwardly and have inwardly directed ends that extend over the outer side edges of sheet member 42 to hold sheet member 42 adjacent wall 21. Flanges 43 and 44, front wall 21 and bottom wall 26 define a generally rectangular slot 46 which is open to the top of holder 20 and has a rectangular shaped front opening. The inwardly directed ends of flanges 43 and 44 are transversely spaced from front wall 21 at a distance slightly wider than the thickness of sheet member 42 whereby sheet member 42 can vertically slide into and out of slot 46. Sheet member 42 can be moved to a raised position to open the enclosed storage compartment 51. When moved to a lowered position, the bottom of sheet member 42 rests on bottom wall 26 to close the opening of compartment 51. The front opening of slot 46 allows the outer reflective surface of sheet member 42 to be exposed.

Similarly, a second generally flat sheet member 57 is mounted on the front of holder 20 adjacent sheet member 42. Flanges 47 and 48 secured to front wall 21 extend forwardly and have inwardly directed ends that extend over the outer side edges of sheet member 57 to hold sheet member 57 adjacent wall 21. Flanges 47 and 48, front wall 21, partition 29, and bottom wall 26 define a slot 56 for accommodating sheet member 57. Sheet member 57 is a generally flat member having an outer surface with graphics, representations, or portraits, such as a baseball card, hockey card or other cards. The transverse space between the ends of flanges 47 and 48 and front wall 21 is slightly wider than the thickness of sheet member 57 whereby sheet member 57 can be vertically slid into and out of slot 56. Slot 56 has a rectangular shaped front opening whereby the outer surface of sheet member 56 is displayed.

Figure 6:
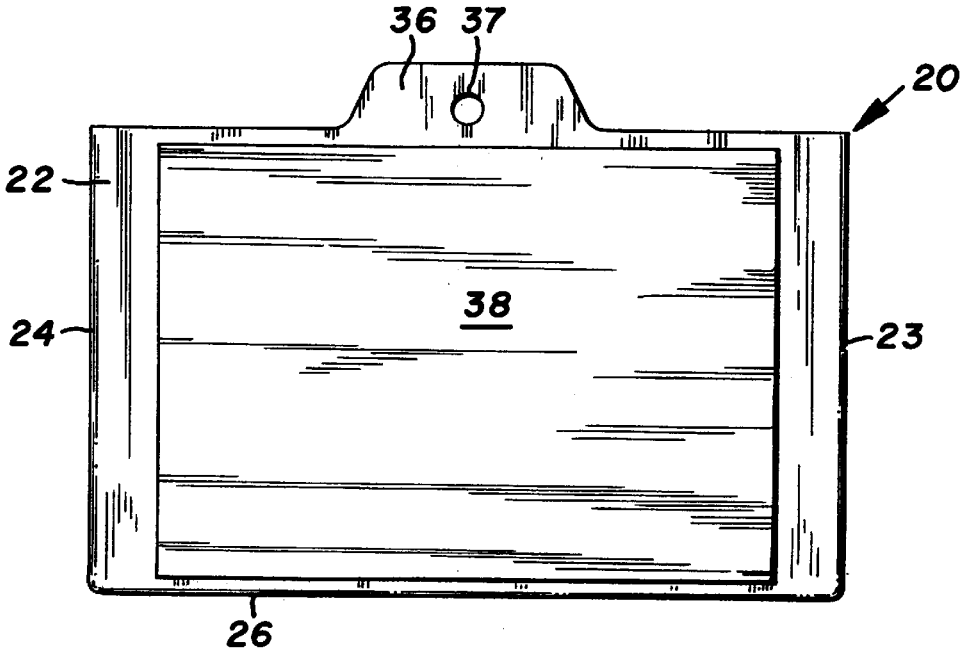
FIG. 6 is a rear elevational view of FIG. 1.

Referring to FIG. 6, a generally flat sheet member 38 is secured to the back side of wall 22. Sheet member 38 is a generally rectangular structure having linear top and bottom edges spaced inwardly from the outer edges of back wall 22. Sheet member 38 can be a flat plastic member having a permanent magnetic field impressed thereon whereby member 38 can be releasably attached to a magnetic metal support. An example of magnetic sheet member 38 is a plastic magnet made by B.F. Goodrich Company, of Marieita, Ohio, marketed under the name KOROSEAL. Sheet member 38 has a generally flat outside surface adapted to be located in surface engagement with a generally flat metal support surface whereby holder 20 is magnetically attached to the support. Sheet member 38 can accommodate other types of holding structures.

While there has been shown and described a preferred embodiment of the article holder of the invention, it is understood that changes, additions and modifications may be made by those skilled in the art without departing from the invention. The invention is defined in the following claims.

I claim:

1. A holder for one or more articles comprising: a receptacle having an open top, upright outer walls, a bottom wall joined to the upright outer walls defining an article carrying space, at least one transverse wall extending across the article carrying space separating the space into a plurality of pockets, an inner horizontal wall located in a longitudinal plane above the bottom wall, upright inside walls joined to the inner wall and bottom wall defining an inner compartment, said upright outer walls having an opening in communication with said inner compartment, and attachment means secured to one of the upright outer walls remote from the pockets for holding the receptacle on a support having a generally flat surface, the attachment means having a generally flat outer surface locatable in surface engagement with the flat surface of the support to retain the box on the support.

2. The holder of claim 1 including: means slidably mounted on the receptacle to close the front of the inner compartment.

3. The holder of claim 2 wherein: the means slidably mounted on the receptacle is a generally flat sheet member vertically slidably mounted on the receptacle.

4. The holder of claim 1 including: a first sheet member vertically slidably mounted on the front of the receptacle closing the front of the inner compartment, and a second sheet member vertically slidably mounted on the front of the receptacle adjacent the first sheet member.

5. The holder of claim 1 wherein: the inner horizontal wall extends parallel to the bottom wall.

6. The holder of claim 1 wherein: the upright outer walls include end walls having downwardly and outwardly slanted top edges.

7. The holder of claim 1 wherein: the attachment means comprises a generally flat sheet member accommodating magnetic material.

8. A holder for one or more articles comprising: a box having an open top, a front wall, a bottom wall, rear wall and side walls joined to the bottom wall, an internal wall extending between the side walls, partition means connected to the internal wall and extended forwardly to the front wall, the front, side and internal walls and partition means defining a plurality of pockets, an inner wall joined to one side wall, internal wall, front wall and partition means defining an inner compartment, said front wall having an opening providing access to said inner compartment, sheet means mounted on the front wall for closing the opening in the front wall thereby concealing the inner compartment, flange means connected to the front wall and bottom wall slidably mounting the sheet means on the front wall whereby the sheet means can be moved relative to the front wall to provide access to said inner compartment, and attachment means secured to the rear wall remote from the pockets for holding the box on a support.

9. The holder of claim 8 wherein: the side walls have top edges extending downwardly and forwardly at an angle from the rear wall toward the front wall.

10. The holder of claim 8 wherein: the partition means include top edges extending downwardly and forwardly at an angle from the internal wall toward the front wall.

11. The holder of claim 8 wherein: the rear wall extends higher than the front wall.

12. The holder of claim 8 wherein: including a forward wall section joined to one of the side walls and bottom wall, the forward wall section extending lower than the front wall.

13. The holder of claim 8 wherein: the internal wall extends parallel to the front and rear walls forming an elongated rear pocket.

14. The holder of claim 8 wherein: the partition means comprise two upright transverse walls extending from the internal wall to the front wall between the side walls forming three forward pockets.

15. The holder to claim 8 wherein: each pocket has an open top and a closed bottom.

16. The holder of claim 8 wherein: the sheet means is a generally flat sheet member vertically slidably mounted on the front wall.

17. The holder of claim 16 wherein: the sheet member has an outer reflective surface.

18. The holder of claim 8 including: a second sheet means slidably mounted on the front wall adjacent the first sheet means.

19. A holder for one or more articles comprising: a boxlike receptacle having a front wall, rear wall, a bottom wall and side walls joined to the bottom wall, a middle wall extending between the side walls, partition means connected to the middle wall and front wall defining a plurality of pockets for accommodating articles, an inner horizontal wall located in a longitudinal plane above the bottom wall, upright inside walls joined to the inner wall and bottom wall defining an inner compartment, said front wall having an opening providing access to said inner compartment, sheet means slidably mounted on the front wall closing the opening in the front wall thereby concealing the inner compartment, and attachment means secured to the rear wall remote from the pockets adapted to be attached to a support for the holder.

20. The holder of claim 19 including: flange means connected to the front wall slidably mounting the sheet means on the front wall.

21. The holder of claim 19 wherein: the rear wall extends higher than the front wall.

22. The holder of claim 19 wherein: the side walls and partition means include top edges extending downwardly and forwardly at an angle toward the front wall.

23. The holder of claim 22 wherein: the angle is about 45 degrees relative to the horizontal.

24. The holder of claim 19 wherein: the partition means comprises two transverse walls joined to the middle wall and the front wall between the side walls forming three forward pockets.

25. The holder of claim 19 wherein: the sheet means is a generally flat sheet member being vertically slidably mounted on the box.

26. An article holder comprising: a generally rectangular container having a front wall, rear wall, and side walls forming outside walls of the container, a bottom wall joined to the outside walls closing the bottom of the container, an internal wall extending between the side walls, the internal wall extending parallel to the front and rear walls forming an elongated rear pocket, transverse partition walls connected to the internal wall and extended forwardly to the front wall, the side walls and partition walls having top edges slanting downwardly and forwardly from the rear of the container to the front thereof, the partition walls extending from the internal wall to the front wall between the side walls forming a plurality of forward pockets, an inner horizontal wall located in a longitudinal plane above the bottom wall, upright inside walls joined to the inner wall and bottom wall defining an inner compartment, said front wall having an opening providing access to the inner compartment, sheet means slidably mounted on the front wall closing the opening in the front wall thereby concealing the inner compartment, and attachment means secured to the rear wall remote from the rear pocket for holding the box on a support having a generally flat surface, the attachment means having a generally flat outer surface locatable in surface engagement with the flat surface of the support to retain the box on the support.

27. The holder of claim 26 wherein: including a forward wall section joined to one of the side walls and bottom wall, the forward wall section extending lower than the front wall.

28. The holder of claim 26 including: flange means connected to the front wall sidably mounting the sheet means on the front wall.

29. The holder of claim 26 wherein: the sheet means is a generally flat sheet member being vertically slidably mounted on the front wall.

30. The holder of claim 26 wherein: the sheet means comprises first and second sheet members slidably mounted on the front wall, said first sheet member closing the opening in the front wall of the container.

* * * * *